US006277320B1

(12) United States Patent
Pai et al.

(10) Patent No.: US 6,277,320 B1
(45) Date of Patent: Aug. 21, 2001

(54) MELT SPINNING METHOD AND ITS APPARATUS

(75) Inventors: H. Y. Peter Pai, Changwa (TW); Koichiro Oshiumi, Kyoto (JP)

(73) Assignees: Suntex Fiber Co., Ltd., Honei (TW); Murata Kikai Kabushiki Kaisha, Kyoto (JP)

( * ) Notice: Subject to any disclaimer, the term of this patent is extended or adjusted under 35 U.S.C. 154(b) by 0 days.

(21) Appl. No.: 09/274,763

(22) Filed: Mar. 24, 1999

(30) Foreign Application Priority Data

Apr. 8, 1998 (JP) ..... 10-095921

(51) Int. Cl.[7] ..... D01D 5/092; D01D 5/098

(52) U.S. Cl. ..... 264/465; 264/211.14; 264/211.15; 425/66; 425/72.2; 425/174.8 E

(58) Field of Search ..... 425/174.8 E, 72.2, 425/66, 464, 382.2; 264/455, 456, 465, 484, 211.15, 211.16, 211.14

(56) References Cited

U.S. PATENT DOCUMENTS 2,338,570 * 1/1944 Childs .
3,097,056 * 7/1963 Rowlinson .
4,316,716 * 2/1982 Lin .
4,486,365 * 12/1984 Kliemann et al. .
5,122,048 * 6/1992 Deeds .

FOREIGN PATENT DOCUMENTS 51-23323 2/1976 (JP) .
62-250211 10/1987 (JP) .

* cited by examiner

*Primary Examiner*—Nam Nguyen
*Assistant Examiner*—Joseph Leyson
(74) *Attorney, Agent, or Firm*—Armstrong, Westerman, Hattori, McLeland & Naughton, LLP

(57) ABSTRACT

A melt spinning apparatus that prevents filaments passing through an unstable area from contacting one another. In a melt spinning method for thinning and solidifying each molten filament F ejected from a plurality of nozzles to obtain a yarn Y comprising a plurality of filaments F, each filament F being thinned is charged to the same polarity, and when the plurality of filaments F are assembled together, charge is eliminated from them. In a melt spinning apparatus 11 having an unstable area A generated necessarily during the rapid thinning of each filament F between a spinning pack 2*a* of an ejecting device 2 located above and a filament converging portion B located below, a charging device 12 is provided that charges each filament F to the same polarity between the spinning pack 2*a* and an inlet Aa of the unstable area A; also, a static eliminating device 13 is provided that eliminates charge from each filament F between an outlet Ab of the unstable area A and the filament converging portion B.

6 Claims, 3 Drawing Sheets

MELT SPINNING METHOD AND ITS APPARATUS

FIELD OF THE INVENTION

The present invention relates to a method and apparatus for melt-spinning thermoplastic polymer that prevents filaments from contacting one another in an unstable area generated necessarily during the rapid thinning of the filaments.

BACKGROUND OF THE INVENTION

The melt spinning method conventionally uses a melt spinning apparatus 1 comprising an ejecting device 2, a spinning chimney 3, an oiling device 4, and a winding device 5, as shown in FIG. 3, in order to cool and solidify each molten filament ejected from a plurality of nozzles provided at a spinning pack 2*a* of the ejecting device 2, using a cooling device 6 provided in the spinning chimney 3. The method subsequently assembles a plurality of filaments F at a converging portion B below the oiling device 4 to form a single yarn Y, which is then wound by the winding device 5.

The melt spinning method involves an unstable area (the so-called "necking area") generated necessarily during the rapid thinning of the filaments F. In the unstable area A, each filament F increases its speed while being rapidly thinned, but the thinning condition differs for each filament, partly because the cooling condition differs between the inside and outside of the filament F. Thus, at a given height in the unstable area, a given filament F does not necessarily move at the same speed as the other filaments F. Accordingly, when the filaments contact one another, fluffs or loops may occur which significantly reduce filament quality or, in the worst case, the filaments are severed and production efficiency is impaired.

Thus, in order to solve this problem, it is an object of the present invention to provide a melt spinning method and apparatus that prevents filaments passing through the unstable area from contacting one another.

SUMMARY OF THE INVENTION

The means employed by the present invention is a melt spinning method for thinning and solidifying each filament ejected from a plurality of nozzles to obtain a yarn comprising a plurality of filaments, characterized in that each filament being thinned is charged to the same polarity.

Since each filament being thinned is charged to the same polarity, the present invention allows filaments being thinned to repel one another and precludes them from contacting one another even if they tend to approach one another.

The means employed by the present invention is a melt spinning method characterized in that before the plurality of filaments are assembled together, charge is eliminated from them.

The present invention eliminates charges from the solidified filaments F prior to assembly, in order to smooth the assembly process.

The means employed by the present invention is a melt spinning apparatus having an unstable area formed due to the thinning of each filament between a spinning pack of an ejecting device located above and a filament converging portion located below, characterized in that a charging device is provided that charges each filament to the same polarity between the spinning pack and an inlet of the unstable area.

According to the present invention, the charging device charges each filament being thinned to the same polarity. Thus, the present invention allows filaments to repel one another and precludes them from contacting one another even if they tend to approach one another.

The means employed by the present invention is a melt spinning apparatus characterized in that a static eliminating device is provided that eliminates charges from each filament between an outlet of said unstable area and said filament converging portion.

According to the present invention, the static eliminating device eliminates charge from the solidified filaments F prior to assembly in order to smooth the assembly process.

The means employed by the present invention is a melt spinning apparatus characterized in that said charging device blows an ionized airflow toward a filament group passage formed between said spinning pack and the inlet of said unstable area.

The present invention can charge each filament to the same polarity by uniformly contacting the ionized airflow toward the plurality of filaments which pass through the filament group passage.

The means employed by the present invention is a melt spinning apparatus characterized in that said charging device includes electrodes for charging that surround the outside of the filament group passage formed between said spinning pack and said inlet of the unstable area.

According to the present invention, discharge from the electrodes ionizes the air in the filament group passage to enable each filament to be charged to the same polarity.

DETAILED DESCRIPTION OF THE PREFERRED EMBODIMENTS

Figure 1:
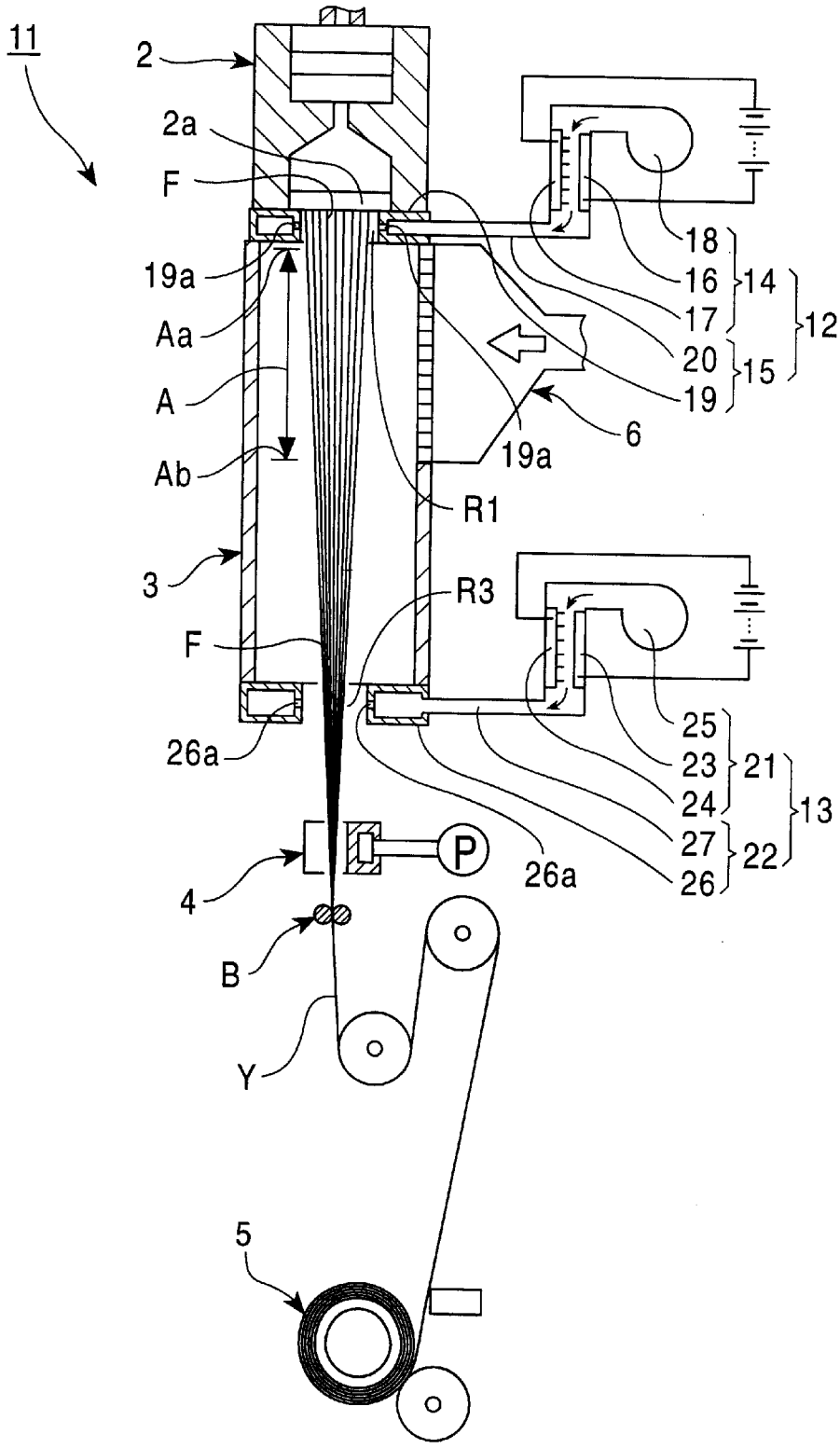
FIG. 1 is a schematic drawing showing a first embodiment of the present invention.

A melt spinning method and apparatus according to the present invention is described based on the embodiments shown in the drawings.

FIG. 1 is a schematic drawing showing a first embodiment of the present invention. A melt spinning apparatus 11 according to this embodiment comprises an ejecting device 2, a spinning chimney 3, a nozzle oiling device 4, a converging guide B, and a winding device 5. A cooling device 6 provided in the spinning chimney 3 cools and solidifies each molten filament F ejected from a plurality of nozzles (not shown in the drawings) provided at a spinning pack 2*a* of the ejecting device 2, while simultaneously thinning the filament rapidly. Then, the nozzle oiling device 4 oils the filaments, the converging guide (filament converging portion) B subsequently assembles them together to form the plurality of filaments F into a single yarn Y, and the winding device 5 then winds it. An unstable area (also referred to as a "necking area") A exists between the spinning pack 2*a* and the filament converging portion B located below the spinning pack 2*a* and comprising a ring. The improvements to the melt spinning apparatus 11 include a charging device 12 for charging each filament F to the same polarity between the spinning pack 2*a* and an inlet Aa of the unstable area A, and a static eliminating device 13 for eliminating charge from each filament F between an outlet Ab of the unstable area A and the filament converging portion B.

Said charging device 12 blows ionized air toward a filament group passage R1 formed between the spinning pack 2*a* and the inlet Aa of the unstable area A, and comprises an ionized air generating device 14 for generating ionized air and an air guiding unit 15 for guiding the ionized air generated to the filament group passage R1. The ionized air generating device 14 comprises a casing 16 that allows air to pass therethrough, an ion generating unit 17 for generating ions in the casing 16 using corona discharge, and a blower 18 connected to an inflow port of the casing 16. The air guiding unit 15 comprises an annular nozzle box 19 provided outside the filament group passage R1 and in which a large number of blowoff openings 19*a* are opened to inject ionized air against a filament group or its passage R1, and a duct 20 that connects an inflow port of the nozzle box 19 and an outflow port of the casing 16. The nozzle box 19 can be divided into two parts to improve the operability in initially passing the filaments F through the passage R1, and may be configured so that the each part obtained by the division moves back and forth between a predetermined blowoff position and a backward position away from the filament group passage R1.

Said static eliminating device 13 blows ionized air toward a filament group passage R3 formed between the outlet Ab of the unstable area A and the filament converging portion B, and comprises a ionized air generating device 21 for generating ionized air having a polarity opposite to the ion polarity of said charging device 12, and an air guiding unit 22 for guiding generated ionized air to the filament group passage R3. The ionized air generating unit 21 comprises a casing 23 that allows air to pass therethrough, an ion generating unit 24 for generating ions in the casing 23 using corona discharge, and a blower 25 connected to an inflow port of the casing 23. The air guiding unit 22 comprises an annular nozzle box 26 provided outside the filament group passage R3 and in which a large number of blowoff openings 26*a* are opened to inject ionized air against a filament group or its passage R3, and a duct 27 that connects the nozzle box 26 and an orifice of the casing 23. The nozzle box 26 can be divided into two parts to improve the operability in initially passing the group of filaments F through the passage R3, and may be configured so that the each part obtained by the division moves back and forth between a predetermined blowoff position and a backward position away from the filament group passage R3. According to the circumstances, the static eliminating device 13 may be omitted.

According to the melt spinning apparatus 11, the charging device 12 charges to the same polarity each filament F melt-spun through the spinning pack 2*a* to enable each filament F being thinned to the same polarity, and the static eliminating device 13 eliminates charge from the solidified filaments F prior to assembly. According to the melt spinning method using this melt spinning apparatus 11, each filament F being thinned is charged to the same polarity while passing thought the unstable area A, thereby allowing the filaments to repel one another and precluding them from contacting one another even if they tend to approach one another. Furthermore, since charge is eliminated from the solidified filaments F prior to assembly, the filaments F can be assembled smoothly. In addition, the adjacent filaments F do not contact each other even if they are forced to approach each other, so the interval between the nozzles (pores) in the spinning pack 2*a* can be reduced to make the apparatus more compact. And finally, since all filaments F are charged to the same polarity, the gap between the filaments F is maintained to allow cooling air from the cooling device 6 to pass therethrough easily, thereby allowing each filament F to be cooled uniformly. When the filaments F charged to the same polarity can be assembled together in such a way as to remain charged, it is not always necessary to eliminate the charge from the solidified filaments F prior to assembly. As the oiling device 4, a roller type oiling device can also use instead of the nozzle type oiling device.

Figure 2:
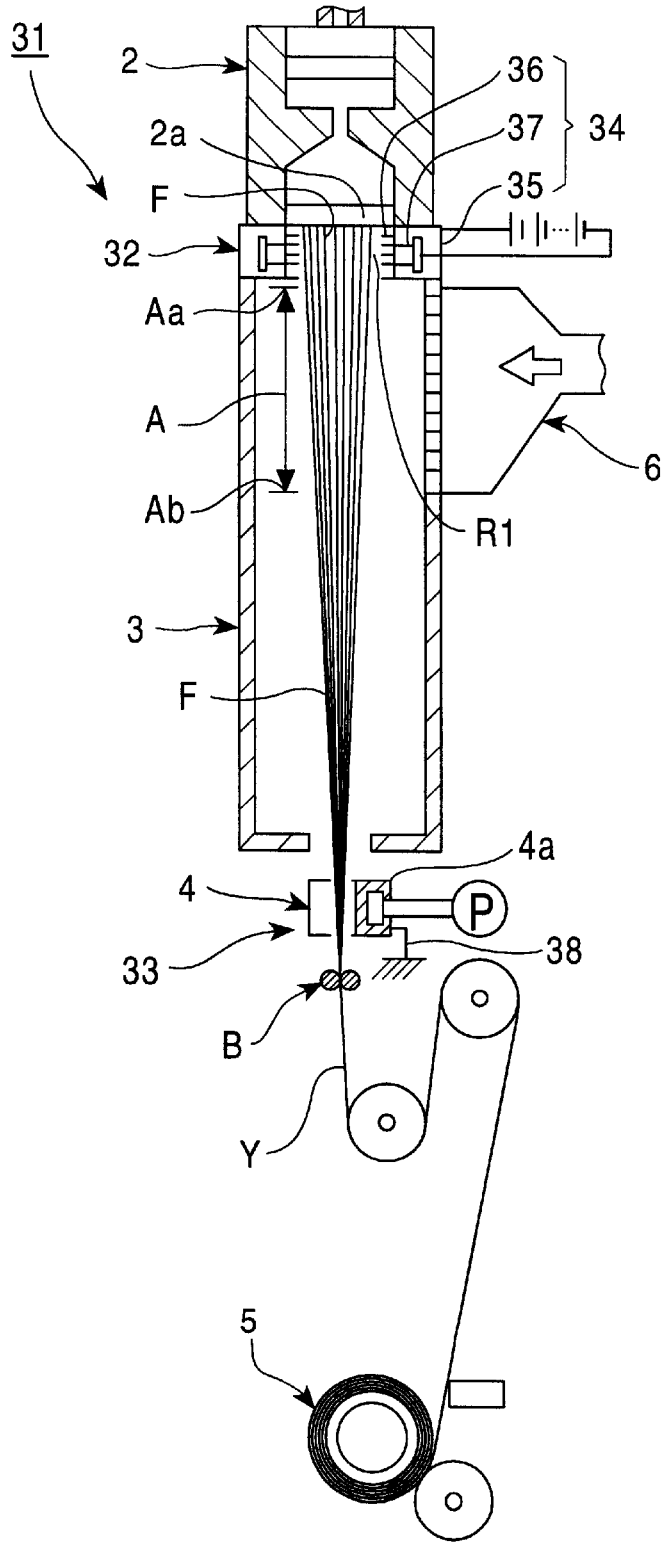
FIG. 2 is a schematic drawing showing a second embodiment of the present invention.
Figure 3:
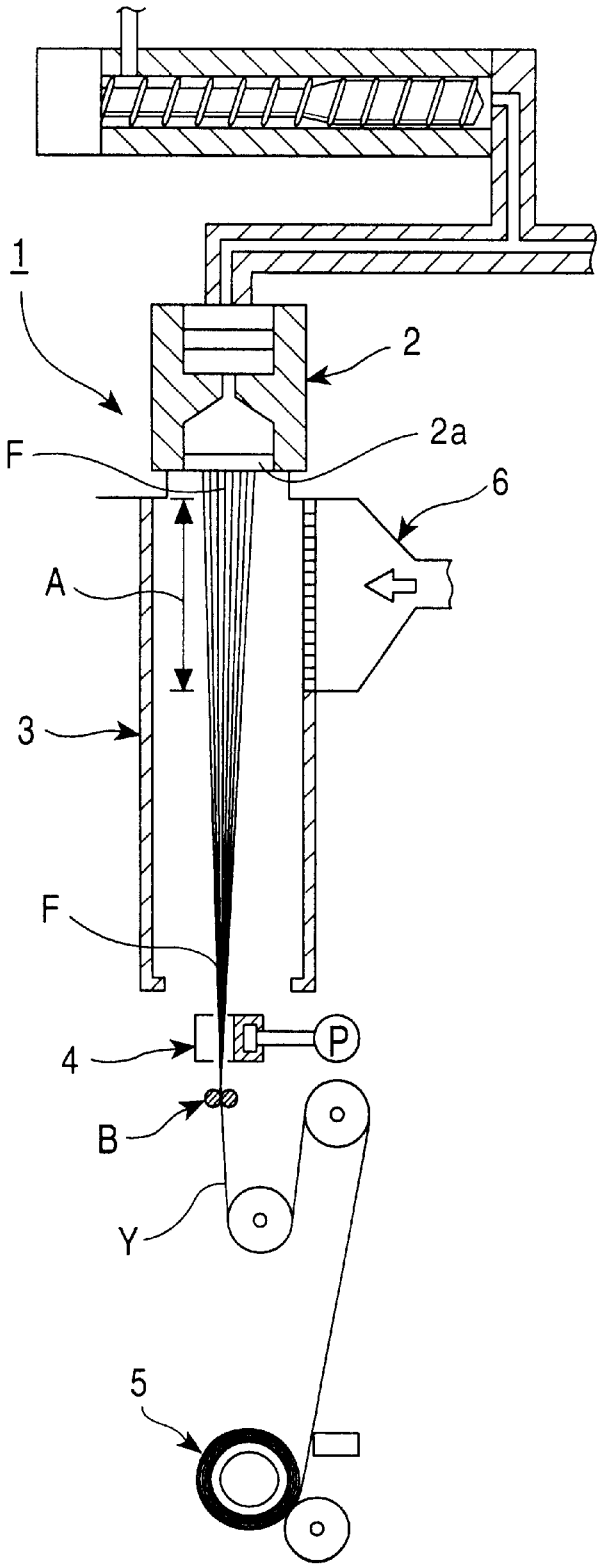
FIG. 3 PRIOR ART
FIG. 3 is a schematic drawing showing a conventional melt spinning apparatus.

FIG. 2 is a schematic drawing showing a second embodiment of the present invention.

A melt spinning apparatus 31 according to this embodiment includes a charging device 32 for charging each filament F to the same polarity between the spinning pack 2*a* and the inlet Aa of the unstable area A and a static eliminating device 33 for eliminating charge from each filament F between the outlet Ab of the unstable area A and the filament converging portion B.

Said charging device 32 includes an electrode unit 34 that surrounds the outside of the filament group passage R1 formed between the spinning pack 2*a* and the inlet Aa of the unstable area A, in order to ionize the atmospheric air in the filament group passage R1. The electrode unit 34 comprises plural sets each including electrodes 36 and 37, and a casing 35 for mounting the electrodes so that discharge occurs between the electrodes 36 and 37. The casing 35 can be divided into two parts to improve the operability in initially passing the filaments F through the filament group passage R1, and may be configured so that the each part obtained by division moves back and forth between a backward position away from the passage R1 and a predetermined discharge position.

Although not shown, in order to move actively the ionized air generated by the electrodes 36 and 37 to the center of the passage R1, said charging device 32 may include a nozzle box for blowing air off so as to move ionized air from the periphery of the electrodes 36 and 37 to the center of the filament group passage R1.

Said static eliminating device 33 may be composed of an earth 38 that conductibly contacts a filament flux immediately before or after convergence in the filament converging portion B, so as to earth the filament flux in order to remove charges therefrom. In this example, a nozzle 4*a* of the oiling device 4 is also used as the earth 38. However, that the converging guiding portion B may also act as the earth. Said static eliminating device 33 may be omitted.

According to the melt spinning apparatus 31, the charging device 32 charges each filament F to the same polarity, so as to enable each filament F being thinned to be charged to the same polarity, while the static eliminating device 33 eliminates charge from the solidified filaments F prior to assembly. According to the melt spinning method used in this melt spinning apparatus 31, each filament F being thinned is charged to the same polarity while passing thought the unstable area A, thereby allowing the filaments F to repel one another and precluding them from contacting one another even if they tend to approach one another. Furthermore, since charge is eliminated from the solidified filaments F prior to assembly, the filaments F can be assembled smoothly. When the filaments F charged to the same polarity can be assembled together in such a way as to remain charged, it is not always necessary to eliminate the charge from the solidified filaments F prior to assembly.

The static eliminating device 13 shown in FIG. 1 may be substituted by the static eliminating device 33 shown in FIG. 2. The charging device 32 shown in FIG. 2 may be substituted by the charging device 12 shown in FIG. 1.

As described above in detail, the present invention charges to the same polarity the filaments passing through the unstable area to allow them to repel one another. Thus, the present invention has an excellent ability to provide high-quality filaments without allowing any inter-filament contact to occur, and to prevent filament cuts so as to significantly improve the production efficiency.

In addition, the interval between the plurality of pores provided in the spinning pack can be reduced to make the spinning pack, and thus the melt spinning apparatus, more compact. The present invention is effective at rapid spinning rates of 4,000 m/min. and up, and is notably effective at 8,000 m/min.

What is claimed is:

1. A melt spinning method for thinning and solidifying each continuous filament, ejected from a plurality of nozzles, to be assembled together to obtain a yarn comprising a plurality of filaments, an unstable area being formed due to the thinning of each filament, characterized in that each filament is charged between the nozzle and air an inlet to the unstable area to the same polarity to repel other filaments being thinned and preclude them from contacting one another until assembled together.

2. A melt spinning method according to claim 1 characterized in that before said plurality of filaments are assembled together, charge is eliminated from them.

3. A melt spinning apparatus having an unstable area formed due to the thinning of each of a plurality of filaments between a spinning pack of an ejecting device located above the unstable area and a continuous filament converging portion located below the unstable area, characterized in that a charging device is provided that charges each continuous filament to the same polarity between the spinning pack and an inlet of the unstable area to repel other continuous filaments being thinned and preclude them from contacting one another until reaching the filament converging portion.

4. A melt spinning apparatus according to claim 3 characterized in that a static eliminating device is provided that eliminates charges from each filament between an outlet of said unstable area and said filament converging portion.

5. A melt spinning apparatus according to claim 3 or claim 4 characterized in that said charging device blows ionized air toward a filament group passage formed between said spinning pack and the inlet of said unstable area.

6. A melt spinning apparatus according to claim 3 or claim 4 characterized in that said charging device includes electrodes for charging that surround the outside of the filament group passage formed between said spinning pack and the inlet of said unstable area.

* * * * *